US009067749B2

(12) United States Patent
Yoshida

(10) Patent No.: US 9,067,749 B2
(45) Date of Patent: Jun. 30, 2015

(54) IMAGE FORMING APPARATUS CAPABLE OF REDUCING TIME AND EFFORT FOR USER IN SETTING SIZE OF IRREGULAR-SIZE SHEET, CONTROL METHOD THEREFOR, AND STORAGE MEDIUM

(71) Applicant: CANON KABUSHIKI KAISHA, Tokyo (JP)

(72) Inventor: Hiroyoshi Yoshida, Tokyo (JP)

(73) Assignee: CANON KABUSHIKI KAISHA (JP)

( * ) Notice: Subject to any disclaimer, the term of this patent is extended or adjusted under 35 U.S.C. 154(b) by 0 days.

(21) Appl. No.: 14/260,373

(22) Filed: Apr. 24, 2014

(65) Prior Publication Data

US 2014/0232056 A1 Aug. 21, 2014

Related U.S. Application Data

(63) Continuation of application No. 13/773,789, filed on Feb. 22, 2013, now Pat. No. 8,746,672.

(30) Foreign Application Priority Data

Feb. 22, 2012 (JP) ..... 2012-036329

(51) Int. Cl.
*B65H 3/44* (2006.01)
*B65H 1/00* (2006.01)
(Continued)

(52) U.S. Cl.
CPC .. *B65H 3/44* (2013.01); *B65H 1/00* (2013.01); *B65H 1/04* (2013.01); *B65H 7/02* (2013.01); *B65H 7/20* (2013.01); *G03G 15/6514* (2013.01);
(Continued)

(58) Field of Classification Search
CPC ..... B65H 2551/00; B65H 2551/10; B65H 2220/04; B65H 3/44
USPC ..... 271/9.05, 9.06, 171; 399/81, 389
See application file for complete search history.

(56) References Cited

U.S. PATENT DOCUMENTS 5,110,106 A * 5/1992 Matsumura et al. ..... 271/9.06
5,289,236 A * 2/1994 Yoshino ..... 399/86
(Continued)

FOREIGN PATENT DOCUMENTS

CN 1151039 A 6/1997
JP 2002160828 A 6/2002
(Continued)

OTHER PUBLICATIONS

Office Action issued in CN201310053494.5, mailed Mar. 6, 2015. English translation provided.

*Primary Examiner* — David H Bollinger
(74) *Attorney, Agent, or Firm* — Rossi, Kimms & McDowell LLP

(57) ABSTRACT

An image forming apparatus which is capable of reducing time and effort for a user in setting a size of an irregular-size sheet. Width information indicative of a width of a sheet set by the user is stored in a storage unit. A width of the sheet held by a sheet holding unit that holds the sheet is detected. From the width information stored in the storage unit, candidates for a size of the sheet are extracted based on the detected width of the sheet. The extracted candidates for a size of the sheet are displayed on a display. A size of the sheet selected by the user from among the displayed candidates for a size of the sheet is set as a size of the sheet held by the sheet holding unit.

14 Claims, 16 Drawing Sheets

(51) Int. Cl.

| | |
|---|---|
| ***B65H 1/04*** | (2006.01) |
| ***B65H 7/02*** | (2006.01) |
| ***B65H 7/20*** | (2006.01) |
| ***G03G 15/00*** | (2006.01) |

(52) U.S. Cl.

CPC ..... *B65H 2407/21* (2013.01); *B65H 2511/10* (2013.01); *B65H 2511/22* (2013.01); *B65H 2511/414* (2013.01); *B65H 2551/18* (2013.01); *B65H 2553/21* (2013.01); *B65H 2557/23* (2013.01); *B65H 2801/06* (2013.01); *G03G 2215/00392* (2013.01); *G03G 2215/00734* (2013.01)

(56) References Cited

U.S. PATENT DOCUMENTS

| | | | | |
|---|---|---|---|---|
| 5,568,229 | A | 10/1996 | Szlucha | |
| 6,266,512 | B1 * | 7/2001 | de Koning et al. | 399/370 |
| 6,817,794 | B2 * | 11/2004 | Kakutani | 400/582 |
| 2003/0141652 | A1 * | 7/2003 | Guddanti et al. | 271/171 |
| 2003/0230842 | A1 * | 12/2003 | Shiho et al. | 271/9.01 |
| 2006/0239731 | A1 | 10/2006 | Suzuki et al. | |
| 2007/0222141 | A1 | 9/2007 | Ozaki | |
| 2008/0042340 | A1 * | 2/2008 | Linder et al. | 271/274 |
| 2008/0073833 | A1 | 3/2008 | Ono et al. | |
| 2008/0084020 | A1 | 4/2008 | Nakamura | |
| 2009/0066011 | A1 * | 3/2009 | Ohno et al. | 271/171 |
| 2009/0230607 | A1 * | 9/2009 | Masui et al. | 271/8.1 |
| 2010/0061785 | A1 | 3/2010 | Kimijima | |
| 2010/0066005 | A1 * | 3/2010 | Ueda | 271/3.17 |
| 2011/0188912 | A1 | 8/2011 | Walsh | |
| 2011/0262198 | A1 * | 10/2011 | Ushiyama | 399/393 |
| 2012/0001377 | A1 | 1/2012 | Miyahara | |
| 2012/0172189 | A1 * | 7/2012 | Watanabe et al. | 493/441 |

FOREIGN PATENT DOCUMENTS

| | | | |
|---|---|---|---|
| JP | 2004256209 | A | 9/2004 |
| JP | 2004-352440 | A | 12/2004 |

* cited by examiner

FIG. 10A

801

| SIZE CODE (ID) | MAIN SCANNING WIDTH (W) | SUB SCANNING WIDTH (L) |
|---|---|---|
| A3 | 297.0 | 420.0 |
| A4 | 297.0 | 210.0 |
| LTR | 279.4 | 215.9 |
| B4 | 257 | 364 |
| B5 | 257 | 182 |
| LGL | 215.9 | 355.6 |
| LTRR | 215.9 | 279.4 |
| A4R | 210.0 | 297.0 |
| A5 | 210.0 | 148.0 |

FIG. 10B

802

| SIZE CODE (ID) | MAIN SCANNING WIDTH (W) | SUB SCANNING WIDTH (L) | DISPLAY NAME (Name) |
|---|---|---|---|
| USR_S1 | 282.0 | 282.0 | "MY ORIGINAL" |
| USR_S2 | 297.0 | 297.0 | "RECTANGULAR A4" |
| USR_S3 | 0 | 0 | "" |
| USR_S4U | 0 | 0 | "" |

IMAGE FORMING APPARATUS CAPABLE OF REDUCING TIME AND EFFORT FOR USER IN SETTING SIZE OF IRREGULAR-SIZE SHEET, CONTROL METHOD THEREFOR, AND STORAGE MEDIUM

BACKGROUND OF THE INVENTION

1. Field of the Invention

The present invention relates to an image forming apparatus, a control method therefor, and a computer-readable storage medium storing a program for implementing the method.

2. Description of the Related Art

Conventionally, there have been image forming apparatuses having a sheet holding unit such as a manual feed tray. The manual feed tray has a guide for measuring widths of sheets. The width of the guide can be set to the same width as a main scanning width or a sub scanning width of a regular size such as A4 or B4, and when the guide is set to this width, a regular size corresponding to this width is set as a size of a sheet for use in printing.

In relation to this, a technique to reset a size of a sheet for use in printing when a difference between the size of the sheet and an already-registered size of a sheet is equal to or greater than a threshold value based on measured values of a guide width, a length, and so on (see, for example, Japanese Laid-Open Patent Publication (Kokai) No. 2004-352440).

According to Japanese Laid-Open Patent Publication (Kokai) No. 2004-352440, however, when an image is to be formed using an irregular-size sheet, information obtained from the guide cannot be effectively used. For example, when a user would like to form an image using an irregular-size sheet having a slightly shorter main scanning width than a width of an A4-size sheet in a main scanning direction, he or she places the sheet on a manual feed tray and brings the guide closer to the sheet until the guide abuts on an end of the sheet.

Because the width of the guide is set to a width other than a width of a regular-size sheet, an image forming apparatus cannot recognize the width of the sheet and thus displays a setting screen to make the user select a sheet again. Alternatively, the image forming apparatus notifies the user that the width of the guide is not set to a width of a regular-size sheet, and then terminates the process.

Thus, whenever the user places an irregular-size sheet on the manual feed tray, he or she needs to input the size of the placed sheet using an operation panel.

In recent years, the number of irregular-size sheets has been increasing, and hence users need to select a sheet for use in image formation from among a large number of irregular-size sheets.

SUMMARY OF THE INVENTION

The present invention provides an image forming apparatus and a control method therefor which are capable of reducing time and effort for a user in setting a size of an irregular-size sheet, as well as a computer-readable storage medium storing a program for implementing the method.

Accordingly, a first aspect of the present invention provides an image forming apparatus comprising a storage unit configured to store width information indicative of a width of a sheet set by a user, a sheet holding unit configured to hold the sheet, a detection unit configured to detect a width of the sheet held by the sheet holding unit, an extraction unit configured to, from the width information stored in the storage unit, extracts candidates for a size of the sheet based on the width of the sheet detected by the detection unit, a display unit configured to display, on a display, the candidates for a size of the sheet extracted by the extraction unit, and a setting unit configured to set a size of the sheet selected by the user from among the candidates for a size of the sheet displayed by the display unit as a size of the sheet held by the sheet holding unit.

Accordingly, a second aspect of the present invention provides a control method for an image forming apparatus, comprising a storage step of storing, in a storage unit, width information indicative of a width of a sheet set by a user, a detection step of detecting a width of the sheet held by a sheet holding unit that holds the sheet, an extraction step of, from the width information stored in the storage unit, extracting candidates for a size of the sheet based on the width of the sheet detected in the detection step, a display step of displaying, on a display, the candidates for a size of the sheet extracted in the extraction step, and a setting step of setting a size of the sheet selected by the user from among the candidates for a size of the sheet displayed in the display step as a size of the sheet held by the sheet holding unit.

Accordingly, a third aspect of the present invention provides a non-transitory computer-readable storage medium storing a program for causing a computer to implement a control method for an image forming apparatus, the control method comprising a storage step of storing, in a storage unit, width information indicative of a width of a sheet set by a user, a detection step of detecting a width of the sheet held by a sheet holding unit that holds the sheet, an extraction step of, from the width information stored in the storage unit, extracting candidates for a size of the sheet based on the width of the sheet detected in the detection step, a display step of displaying, on a display, the candidates for a size of the sheet extracted in the extraction step, and a setting step of setting a size of the sheet selected by the user from among the candidates for a size of the sheet displayed in the display step as a size of the sheet held by the sheet holding unit.

Accordingly, a fourth aspect of the present invention provides a control method for an image forming apparatus comprising a sheet holding unit configured to hold a sheet, a determining unit configured to determine a width of the sheet held on the sheet holding unit, a receiving unit configured to receive, from a user, size information indicating a size of a sheet, a storage unit configured to store the size information received by the receiving unit, and a setting unit configured to set a size of the sheet held by the sheet holding unit based on the width determined by the determining unit and the size information stored in the storage unit.

According to the present invention, time and effort for a user in setting a size of an irregular-size sheet can be reduced.

Further features of the present invention will become apparent from the following description of exemplary embodiments (with reference to the attached drawings).

BRIEF DESCRIPTION OF THE DRAWINGS

FIGS. 7A and 7B are plan views schematically showing an arrangement of a manual feed tray appearing in FIG. 3, in which FIG. 7A shows an upper side of the manual feed tray, and FIG. 7B shows a rear side of the manual feed tray.

FIGS. 10A and 10B are views showing tables stored in a DISK appearing in FIG. 2, in which FIG. 10A shows a regular-size table, and FIG. 10B shows a user-set size table.

DESCRIPTION OF THE EMBODIMENTS

A detailed description will now given of an embodiment of the present invention with reference to the drawings.

Figure 1:
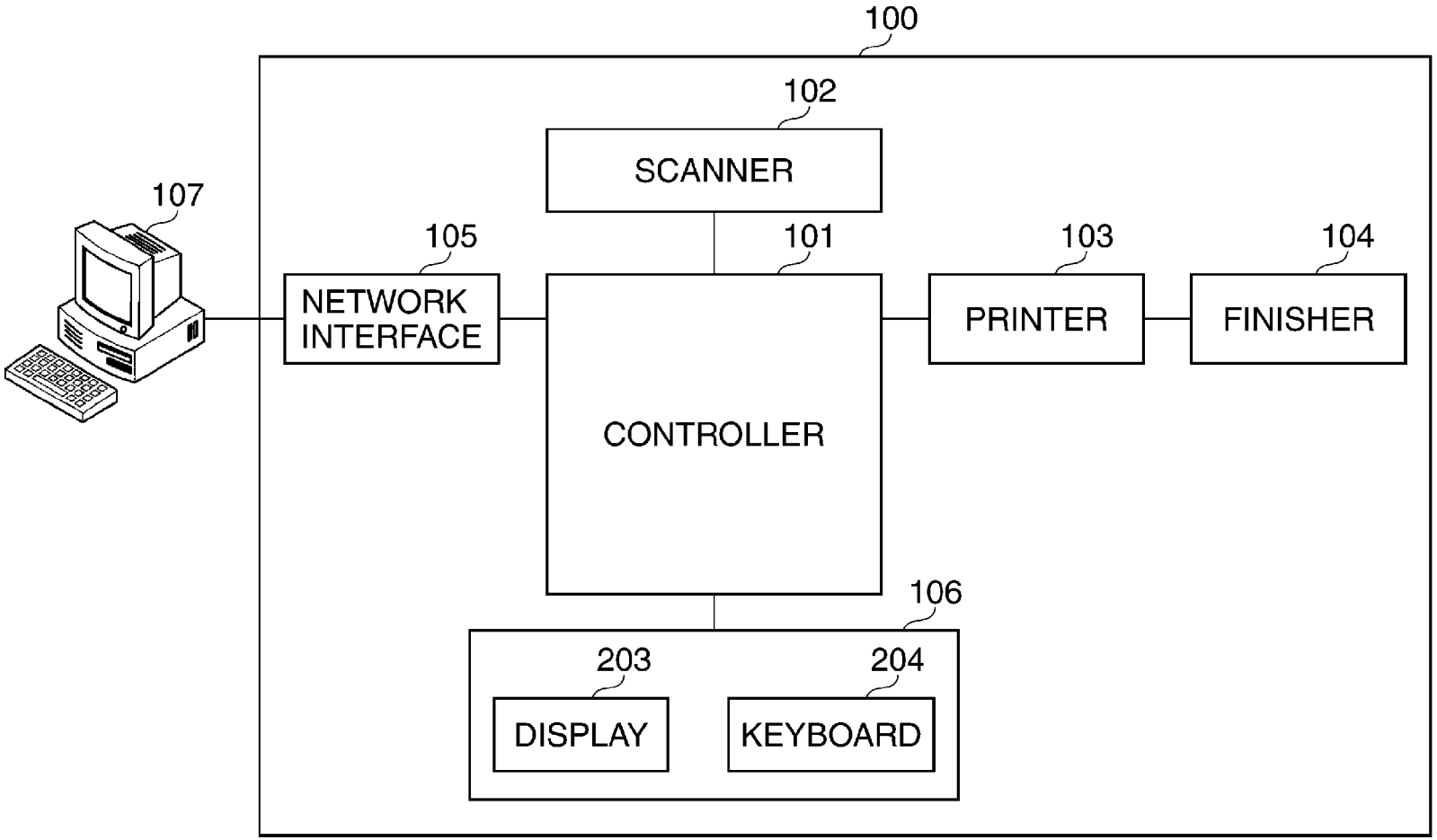
FIG. 1 is a diagram schematically showing an arrangement of an image processing apparatus according to an embodiment of the present invention.

FIG. 1 is a diagram schematically showing an arrangement of an image processing apparatus 100 (printing apparatus) that is an exemplary image forming apparatus according to the embodiment of the present invention.

Referring to FIG. 1, the image processing apparatus 100 is comprised of a controller 101, a scanner 102, a printer 103, a finisher 104, a network interface 105, and an operation unit 106.

The controller 101 controls the image processing apparatus 100. A detailed description of the controller 101 will be given later. The scanner 102 is controlled by the controller 101 connected thereto via a bus. The scanner 102 illuminates an image on a sheet, which is an original, and scans the sheet with a CCD line sensor to read the image off the original and generate image data. Based on the generated imaged data, a color, size, and so on of the original are determined.

The printer 103 is controlled by the controller 101 connected thereto via a bus and prints an image on a sheet (recording medium). The printer 103 is also connected to a manual feed D/A converter that converts analog data indicative of width information on a manual feed guide width, which is obtained from a manual feed tray, to be described later, into manual feed guide width data that is digital data. The manual guide width data obtained as a result of the conversion by the manual feed D/A converter is sent to the controller 101 by the printer 103.

The finisher 104 is capable of bundling and stapling a plurality of sheets that have been subjected to printing by the printer 103. It should be noted that although in the figure, the finisher 104 is connected to only the printer 103 for the sake of clarity, the finisher 104 is connected to the controller 101 via a bus and controlled by the controller 101.

The network interface 105, which is an interface to a network such as Ethernet (registered trademark), makes bidirectional communications available to the controller 101 over the network and is capable of connecting to a personal computer 107 via the network. Instructions to carry out image processing such as printing can be sent from this personal computer 107 as well.

The operation unit 106, which is a user interface, has touch panel functions and is comprised of a display 203 (display unit), on which information is displayed, and a keyboard 204. The operation unit 106 displays information from the controller 101 and transmits instructions from a user to the controller 101. Specifically, a process in which information is displayed on the display 203 is carried out by a CPU 201 appearing in FIG. 2 reading, from a DISK 211 (storage unit), a program corresponding to a screen that should be displayed. The CPU 201 refers to data or the like in a memory 202, reads out screen drawing data from the DISK 211, and lays out a display screen on a VRAM in which data to be displayed on the display 203 is stored. As a result, data stored in the VRAM is displayed on the display 203.

Figure 2:
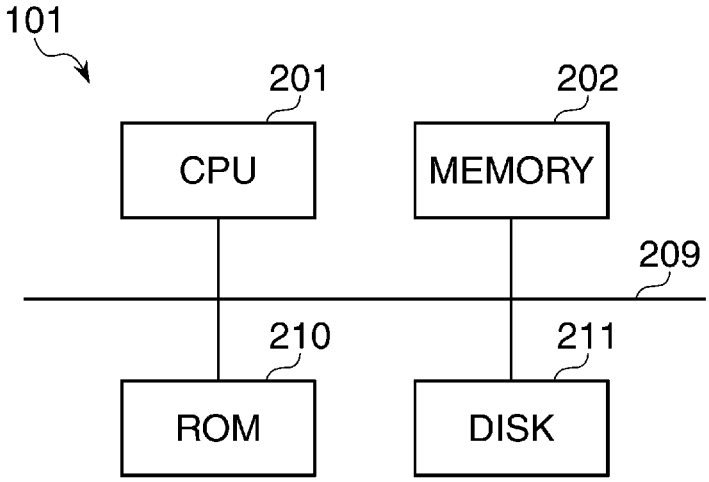
FIG. 2 is a diagram schematically showing a hardware arrangement of a controller appearing in FIG. 1.

FIG. 2 is a diagram schematically showing a hardware arrangement of the controller 101 appearing in FIG. 1.

Referring to FIG. 2, the controller 101 includes the CPU 201, the memory 202, a ROM 210, and the DISK 211, which are connected together via a bus 209.

The CPU 201 controls the entire image processing apparatus 100. The memory 202 is used as a work area for the CPU 201 and is used to, for example, expand programs for carrying out image processing. Various information including programs for operating the image forming apparatus 100 is stored in the ROM 210.

The DISK 211 is a hard disk, a flexible disk, a semiconductor disk, or the like. Various control programs are stored in the DISK 211, and these control programs are successively read out into the memory 202 as the need arises and executed by the CPU 201.

The DISK 211 may be removable from the image forming apparatus 100 or incorporated in the image forming apparatus 100. The various programs mentioned above may be downloaded via a network and stored in the DISK 211.

The DISK 211 and the memory 202 are capable of storing data obtained by the scanner 102 or the network interface 105. Data may be stored in advance in the memory 202, which is removable, and the memory 202 may be mounted in the controller 101 so that the controller 101 can capture data from the memory 202.

Further, image data stored in the DISK 211 can be moved to or copied to the memory 202. Various additional images such as numeric portions of pages can be added to image data stored in the memory 202 based on an instruction sent from the operation unit 106.

In this arrangement, the CPU 201 causes the display 203 to produce displays, and also, the CPU 201 reads out data input via the keyboard 204 or the display 203 to thus receive instructions from the user. Information indicative of the received instructions is transferred to and stored in the memory 202 or the DISK 211 and used for various processes.

Also, the CPU 201 carries out communications using the network by reading data from the network interface 105 or sending data to the network interface 105.

Further, by sending and receiving data to and from the scanner 102, the printer 103, and the finisher 104, the CPU 201 causes these devices to perform operations such as scanning, printing, and post-processing and obtain various statuses of these devices.

It should be noted that the printer 103, the finisher 104, and the scanner 102 may not be inside the image forming apparatus 100 but may be respective independent peripheral devices on the network and controlled by the controller 101 via the network.

Figure 3:
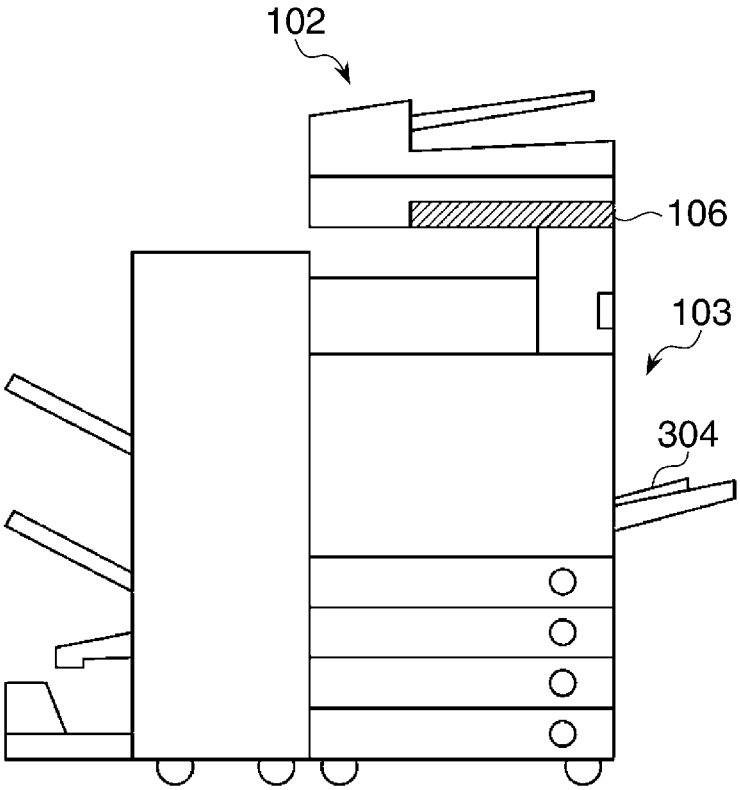
FIG. 3 is a diagram schematically showing an exterior appearance of the image processing apparatus appearing in FIG. 1

FIG. 3 is a diagram schematically showing an exterior appearance of the image processing apparatus 100 appearing in FIG. 1

Referring to FIG. 3, the scanner 102 described above is located in an upper part of the image forming apparatus 100, and the printer 103 is located on top of a plurality of cassettes in which sheets are held. The operation unit 106 is integrated with the scanner 102. The manual feed tray 304 is located in the vicinity of the printer 103. It should be noted that the plurality of cassettes and the manual feed tray 304 act as a sheet holding unit that holds sheets.

Figure 4:
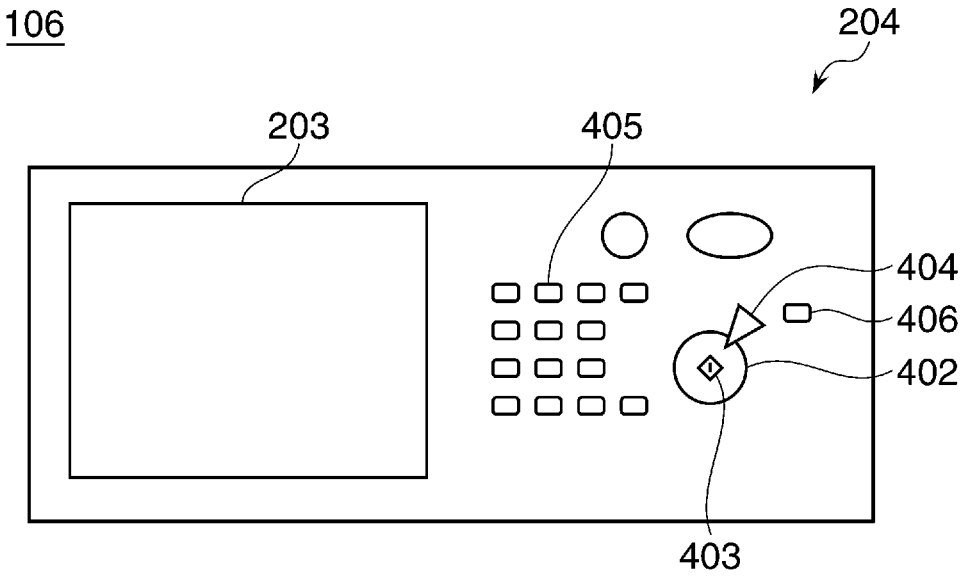
FIG. 4 is a diagram schematically showing an arrangement of an operation unit appearing in FIG. 3.

FIG. 4 is a diagram schematically showing an arrangement of the operation unit 106 appearing in FIG. 3.

Referring to FIG. 4, the display 203, to which a touch panel sheet is attached, displays operation screens and software keys, and when a software key being displayed is depressed, positional information on this key is transmitted to the CPU 201 of the controller 101.

A description will now be given of the keyboard 204. A start key 402 is used to start an original reading operation or the like. There is an LED 403 of two colors, green and red, in a central part of the start key 402, and the color of the LED 403 indicates whether or not the start key 402 is operative. A stop key 404 acts to stop an operation being currently performed.

A numeric keypad 405, which is comprised of numeric buttons and character buttons, is for setting the number of copies and giving instructions to switch screens on the display 203. A user mode key 406 is depressed to configure devices.

Figure 5:
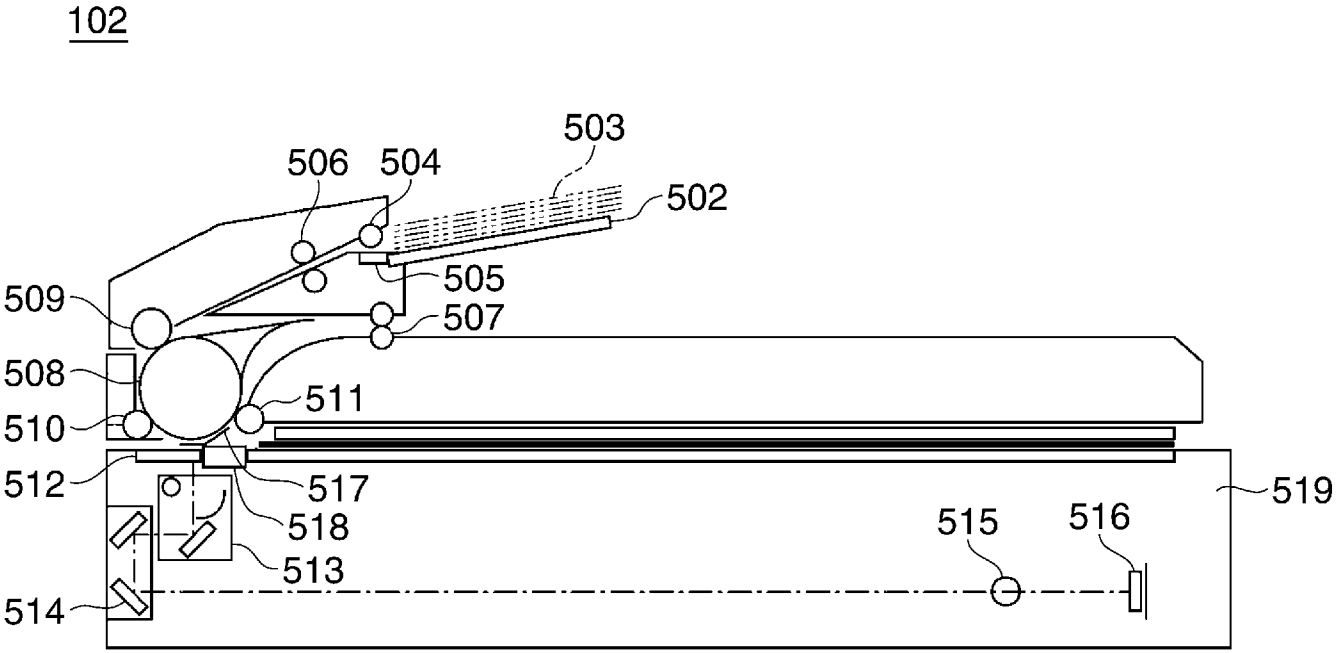
FIG. 5 is a diagram schematically showing an arrangement of a scanner appearing in FIG. 3.

FIG. 5 is a diagram schematically showing an arrangement of the scanner 102 appearing in FIG. 3.

The scanner 102 reads images off originals 503 while moving the originals 503 relative to an exposure unit 513 of an original reading device 519. The originals 503 are placed on an original tray 502. An original feed roller 504 is paired with a separation pad 505 and conveys the originals 503 one by one.

The conveyed original 503 is conveyed by intermediate rollers 506, a large roller 508, and a first driven roller 509, and then the large roller 508 and a second driven roller 510. The original 503 conveyed by the large roller 508 and the second driven roller 510 passes between a flow reading original glass 512 and an original guide plate 517 and is conveyed by the large roller 508 and a third driven roller 511 by way of a jump stage 518.

The original 503 conveyed by the large roller 508 and the third driven roller 511 is discharged from the apparatus by an original discharge roller pair 507. It should be noted that between the flow reading original glass 512 and the original guide plate 517, the original 503 is conveyed while being held in contact with the flow reading original glass 512 by the original guide plate 517.

When passing over the flow reading original glass 512, a surface of the original 503 which is in contact with the flow reading original glass 512 is exposed to light by the exposure unit 513. A reflected light obtained from the original 503 as a result is transmitted to a mirror unit 514. The transmitted reflected light passes through a lens 515, made to converge and converted into an electric signal by a CCD sensor unit 516, and then transmitted to the controller 101.

Figure 6:
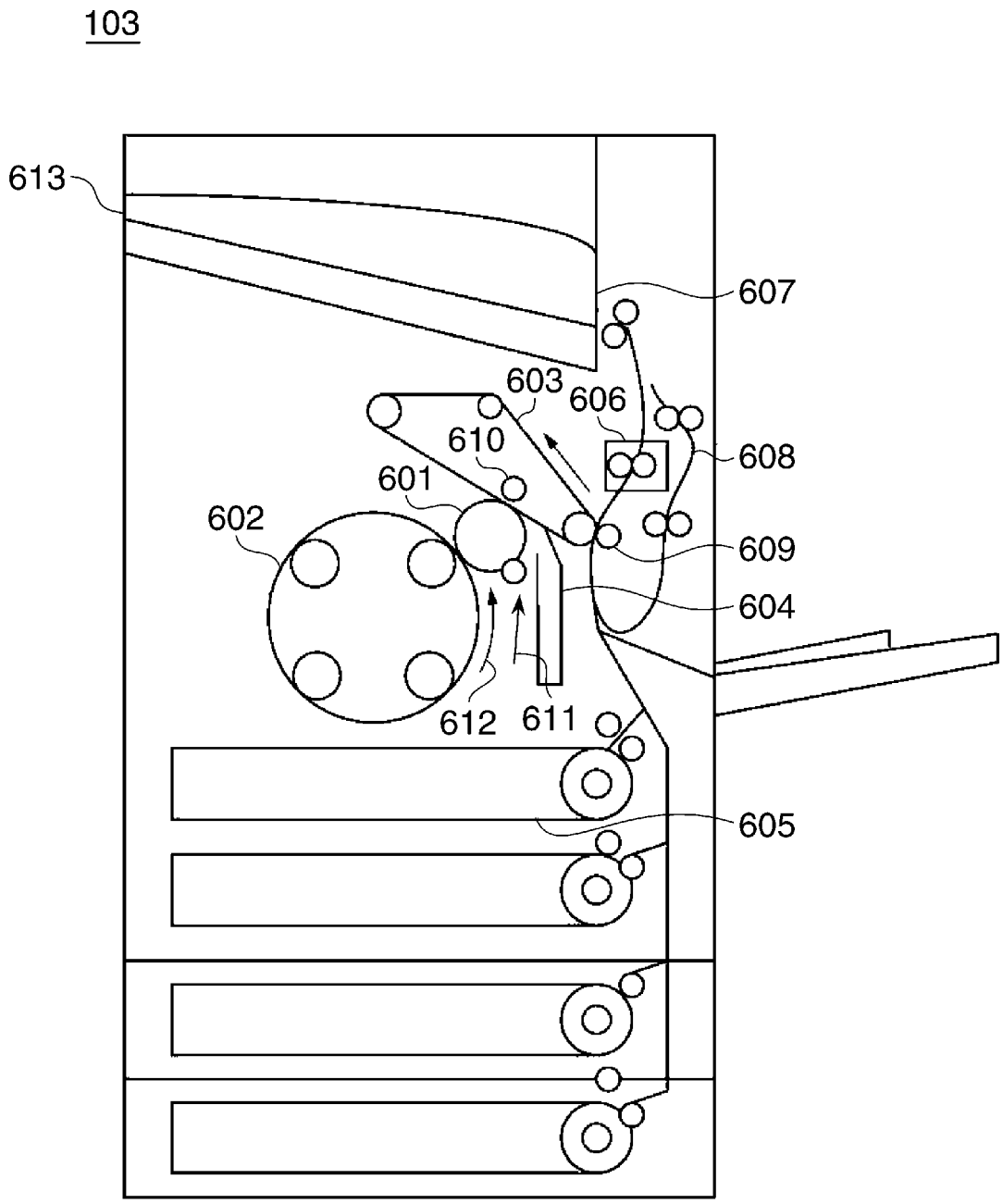
FIG. 6 is a diagram schematically showing an arrangement of a printer appearing in FIG. 3.

FIG. 6 is a diagram schematically showing an arrangement of the printer 103 appearing in FIG. 3.

FIG. 6 shows an exemplary arrangement of the printer 103 in a case where printing in full color, i.e. four colors is performed.

A photosensitive drum 601 is electrically charged to a specific polar potential by a primary charger 611, and at a position indicated by an arrow 612, exposed to light by an exposure unit, not shown, in accordance with an instruction from the controller 101. As a result, an electrostatic latent image corresponding to a first color component is formed on the photosensitive drum 601.

Then, the formed electrostatic latent image is developed on the photosensitive drum 601 using one of a plurality of developing devices 602. An intermediate transfer belt 603 is driven to move in a direction indicated by an arrow in the figure, and in the process of passing through a nip between the photosensitive drum 601 and the intermediate transfer belt 603, the first color component image developed on the photosensitive drum 601 is transferred to the intermediate transfer belt 603 by an electric field formed by a first transfer roller 610.

A surface of the photosensitive drum 601 from which transfer to the intermediate transfer belt 603 has been completed is cleaned by a cleaning device 604. This process is successively repeated, so that images of the four colors are superposed on top of one another on the intermediate transfer belt 603 to form a color image.

On the other hand, to form a monochrome image, the transfer process is carried out only once. An image transferred onto the intermediate transfer belt 603 is printed on a sheet, which is fed from a cassette 605, at a secondary transfer roller 609. The sheet with the image printed thereon is heated by a fixing unit 606, so that the image transferred from the intermediate transfer belt 603 is fixed on the sheet. After the image is fixed, the sheet is conveyed to a sheet discharge port 613 via a sheet discharge unit 607 and discharged from the apparatus. When double-sided printing is to be performed, the sheet is circulated through an inverting path 608, and the printing process is carried out again.

Figure 7A:
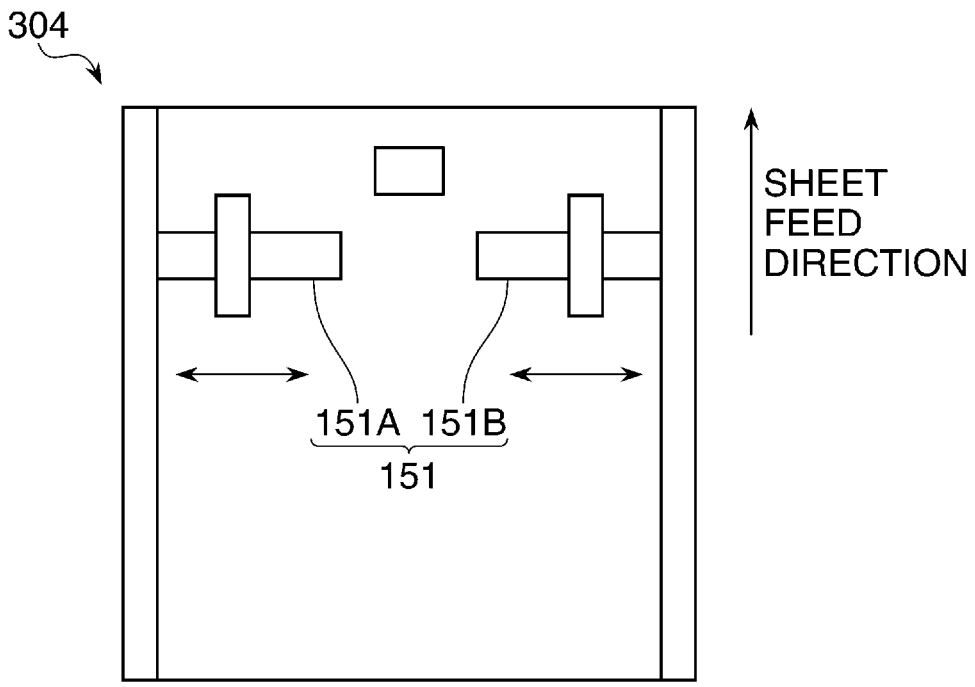
Figure 7B:
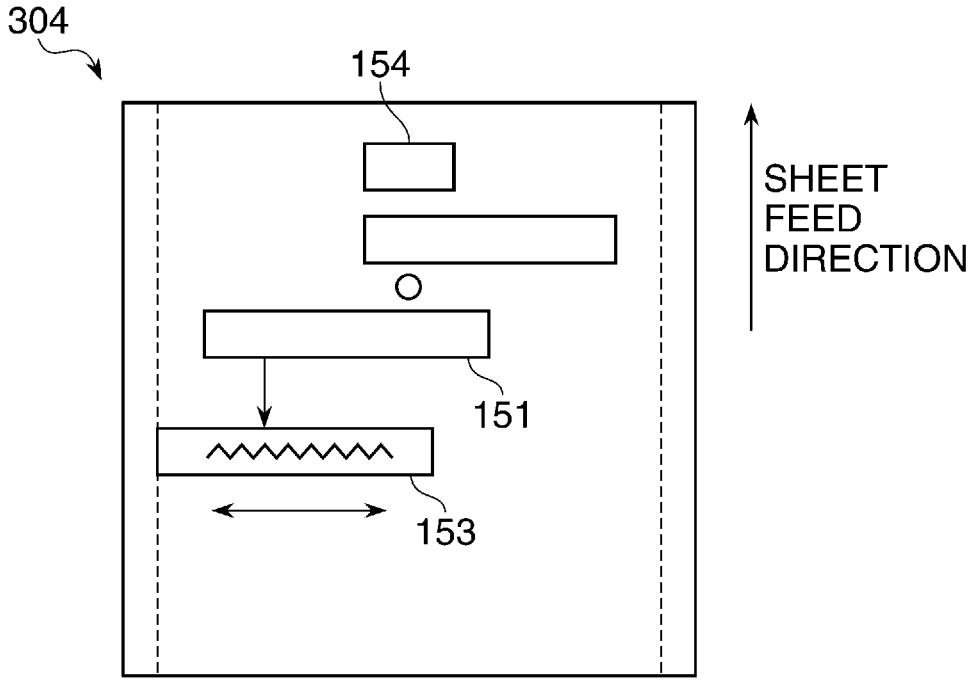

FIGS. 7A and 7B are plan views schematically showing an arrangement of the manual feed tray 304 appearing in FIG. 3, in which FIG. 7A shows an upper side of the manual feed tray 304, and FIG. 7B shows a rear side of the manual feed tray 304.

Referring to FIG. 7A, a sheet restraining guide 151 is configured to be slidable in directions indicated by double-headed arrows in the figure and is configured such that when one of a guide 151A and a guide 151B is moved, the other one moves in response to this. For example, when the guide 151A is moved to the left, the guide 151B moves to the right. Also, when the guide 151A is moved to the right, the guide 151B moves to the left. On the other hand, when the guide 151B is moved to the right, the guide 151A moves to the left. Also, when the guide 151B is moved to the left, the guide 151A moves to the right.

Figure 8:
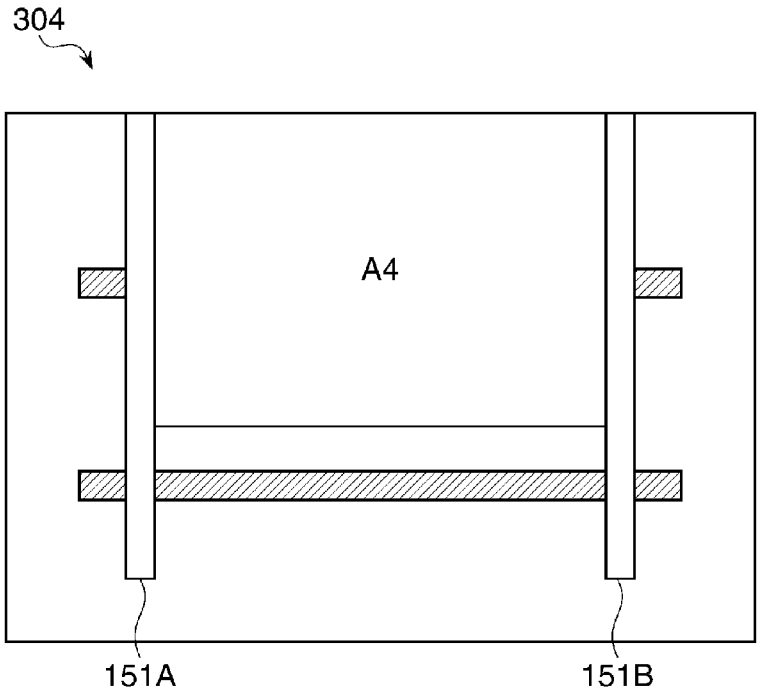
FIG. 8 is a view showing an example in which an A4-size sheet is placed on the manual feed tray such that a longitudinal direction of the A4-size sheet corresponds to a main scanning direction.

FIG. 8 is a view showing an example in which an A4-size sheet is placed on the manual feed tray 304 such that a longitudinal direction of the A4-size sheet corresponds to a main scanning direction. The sheet is conveyed upward as viewed in FIG. 8.

The guide 151A or the guide 151B restrains, in a non-step manner, the horizontal width (the width in the direction of a generating line of the photosensitive drum) of a manual feed sheet placed on the manual feed tray 304. A width detection volume 153 is connected to the sheet restraining guide 151 as shown in FIG. 7B so as to linearly detect sheet sizes from a minimum size of sheets that can be placed (for example, a name card size) to a maximum sheet size.

As a result of detection by the width detection volume 153, an analog voltage of 0(V) to 5(V) corresponding to a sheet width, that is, a guide width is generated, and the generated analog voltage is input to a manual feed D/A converter, not shown. The manual feed D/A converter converts the input analog voltage into a digital value in a tenth of a millimeter by digital-to-analog conversion.

Figure 9:
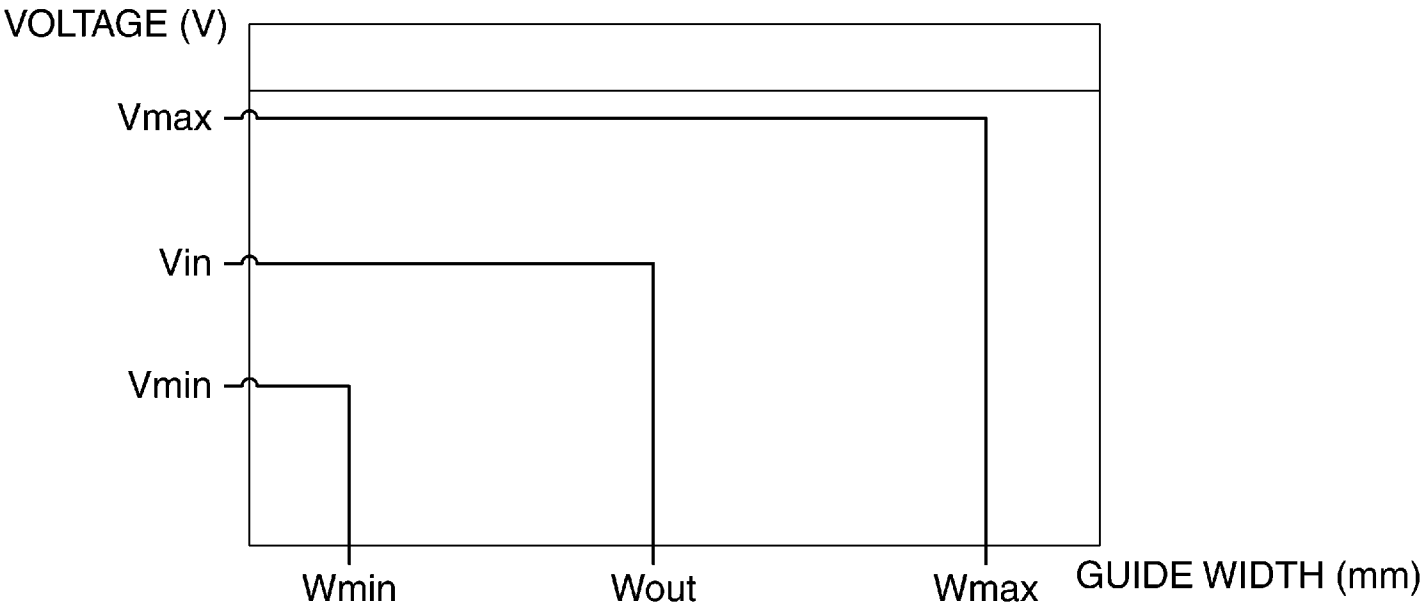
FIG. 9 is a diagram showing the relationship between guide width and voltage.

FIG. 9 is a diagram showing the relationship between guide width and voltage.

As shown in FIG. 9, digital-to-analog conversion is linear conversion in which an input minimum voltage (Vmin) is converted into a mechanical minimum width (Wmin), and an input maximum voltage (Vmax) is converted into a maximum width (Wmax).

Referring to FIG. 7B again, a sensor 154 detects the presence or absence of a sheet. When a manual feed sheet is placed on the manual feed tray 304, the sensor 154 is turned on, and when there is no manual feed sheet on the manual feed tray 304, the sensor 154 is off.

FIGS. 10A and 10B are views showing tables stored in the DISK 211 appearing in FIG. 2, in which FIG. 10A shows a regular-size table 801, and FIG. 10B shows a user-set size table 802.

Referring to FIG. 10A, the regular-size table 801 is comprised of size code (ID), main scanning width (W), and sub scanning width (L).

On the other hand, referring to FIG. 10B, the user-set size table 802 is comprised of size code (ID), main scanning width (W), and sub scanning width (L) as with the regular-size table 801, as well as display names (Name).

In either table, main scanning width (W) and sub scanning width (L) are set in a tenth of a millimeter. In the user-set size table 802, unregistered entries are null in main scanning width (W) and sub scanning width (L).

Thus, width information indicative of sheet widths set by the user and widths of regular-size sheets is stored in the DISK 211. The user-set size table 802 is width information indicative of sheet widths set by the user, and the regular-size table 801 is width information indicative of regular-size sheet widths.

Figure 11:
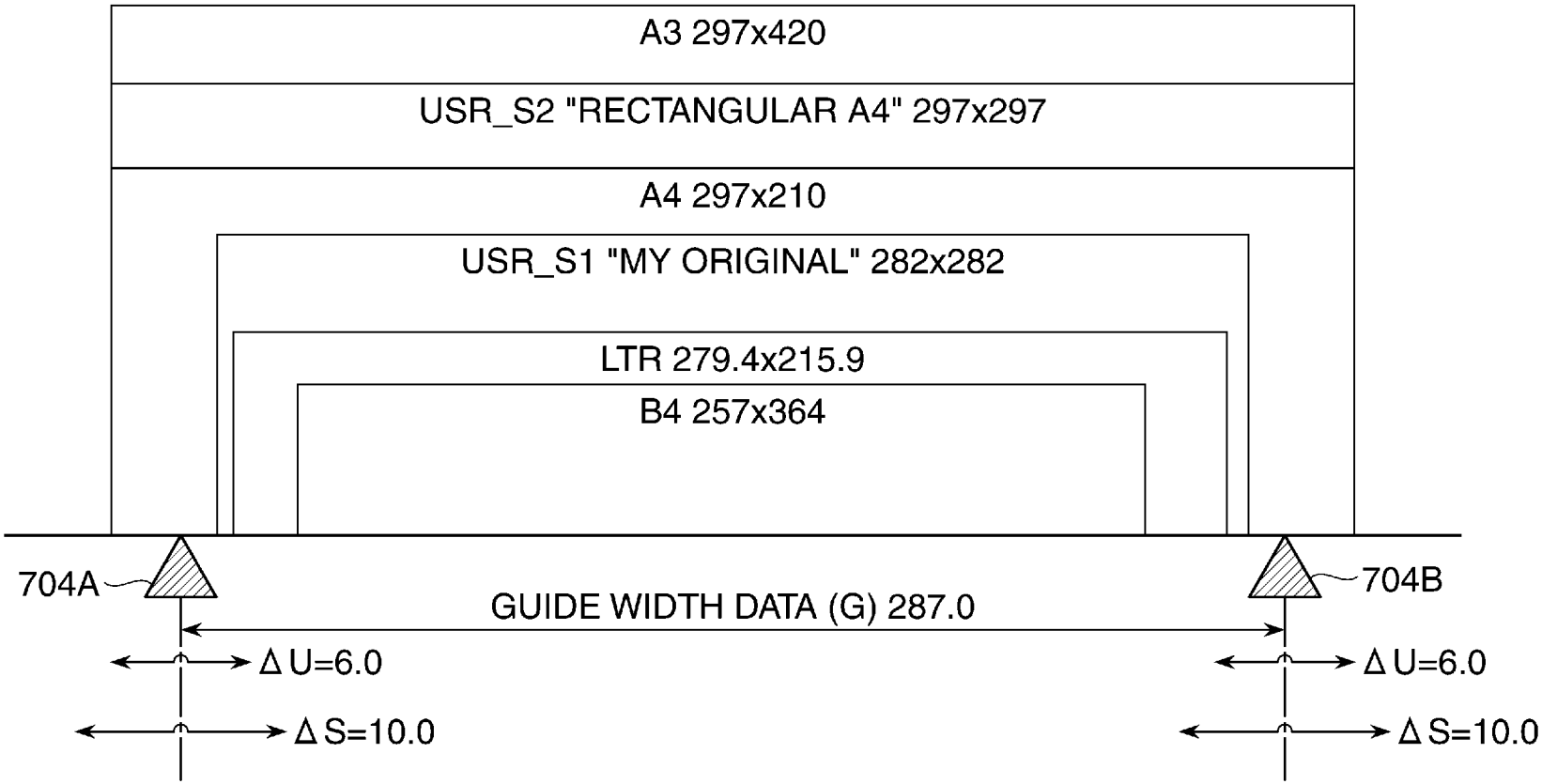
FIG. 11 is a view showing the relationship between measured values of sheets and regular or user-set sheet sizes.

FIG. 11 is a view showing the relationship between measured values of sheets and regular or user-set sheet sizes.

Referring to FIG. 11, arrows 704A and 704B indicate positions of the guides 151A and 151B, respectively. In this example, it is assumed that the read-out value of guide width data (G) is 287.0 mm.

Further, a user-set size determination error (ΔU) is 6.0 mm, and a regular-size determination error (ΔS) is 10.0 mm.

FIGS. 12A to 12G are views showing exemplary display screens displayed on the display 203 appearing in FIG. 4.

A common confirm button in FIGS. 12A to 12G is a button for finalizing a setting being displayed and closing a current screen to display a screen displayed before the current screen. When a setting is finalized by the confirm button, the finalized setting is stored in the memory 202 or the DISK 211 by the CPU 201. A common cancel button in FIGS. 12C to 12E and 12G is a button for canceling a setting being displayed and closing a current screen to display a screen displayed before the current screen.

Figure 12A:
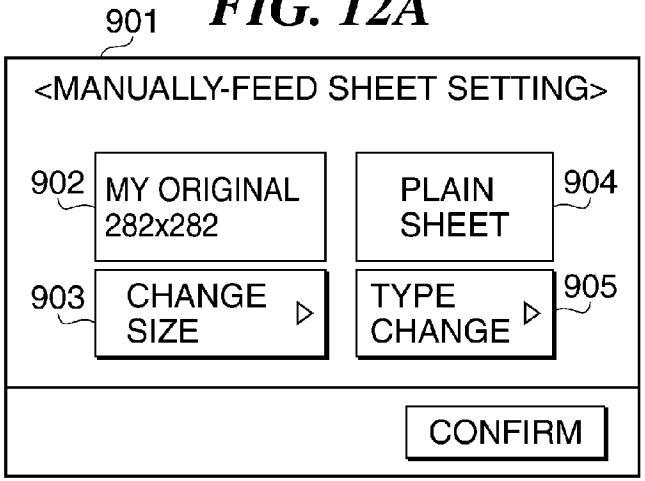
FIGS. 12A to 12G are views showing exemplary display screens displayed on a display appearing in FIG. 4.

FIG. 12A is a view showing a manual feed sheet setting screen 901. This manual feed sheet setting screen 901 is displayed when a sheet setting button on a copy screen is depressed, and a button for setting a sheet on the manual feed tray is depressed. On the manual feed sheet setting screen 901, a size display area 902 indicative of a size of a sheet set for the manual feed tray 304 and a sheet type display area 904 indicative of a type of the sheet are displayed.

Figure 12B:
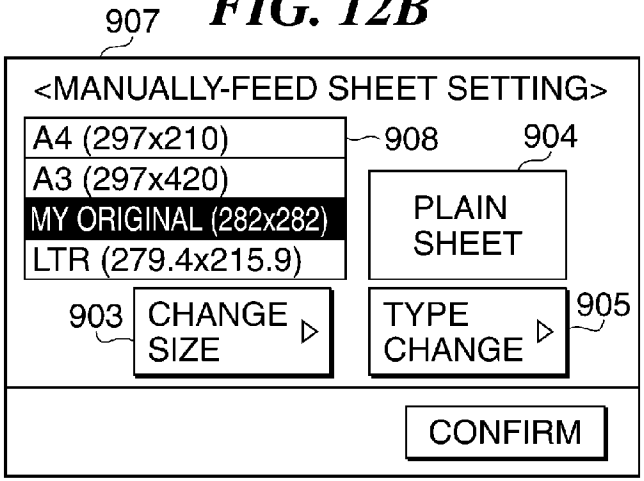

FIG. 12B is a view showing a manual feed sheet setting screen 907. This manual feed sheet setting screen 907 is displayed when the user depresses the size display area 902 on the manual feed sheet setting screen 901 appearing in FIG. 12A. On the manual feed sheet setting screen 907, a candidate size list 908 indicative of sheet sizes set for the manual feed tray 304, and a sheet type display area 904 indicative of a sheet type are displayed.

Candidate sizes listed by a manual feed size determination process, to be described later, are displayed in the candidate size list 908. By selecting a row in the candidate size list 908, the user can set a desired size from among the sheet sizes listed as candidates.

Figure 12C:
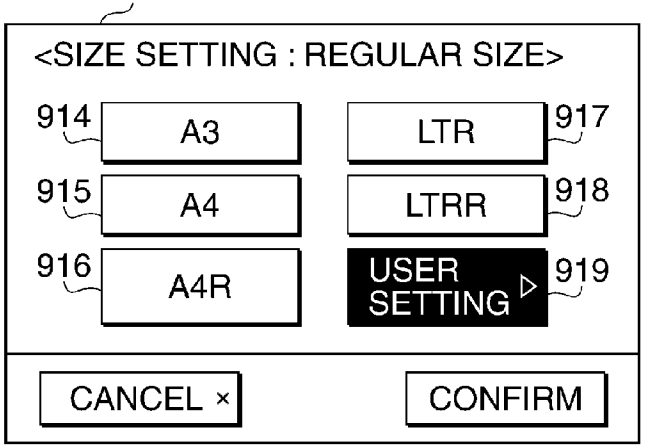

When there is no desired size in the candidate size list 908, the user depresses a size change button 903, causing a size setting screen 913 appearing in FIG. 12C to be displayed. Also, the user depresses a type change button 905, causing a manual feed type setting screen 910 appearing in FIG. 12D to be displayed.

The size setting screen 913 appearing in FIG. 12C is a screen for setting a regular size and displaying a user-set size screen. By the user depressing one of an A3 button 914, an A4 button 915, an A4R button 916, an LTR button 917, and an LTRR button 918, a size code corresponding to the depressed button is set as a manual feed size code by the CPU 201. A user setting button 919 is a button for displaying a user-set size setting screen 926 appearing in FIG. 12E.

Figure 12D:
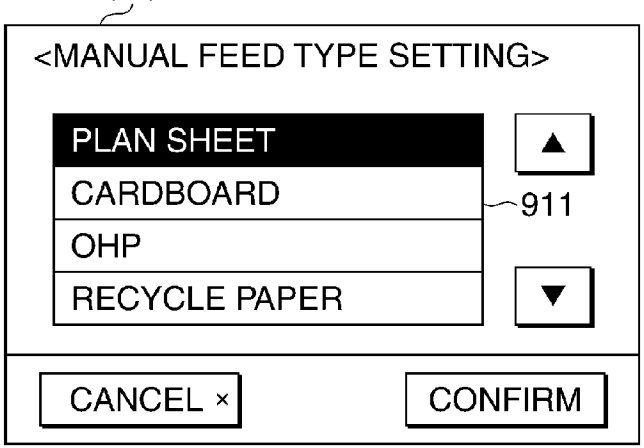

FIG. 12D is a view showing the type setting screen 910. The type setting screen 910 appearing in FIG. 12D is a screen for setting a sheet type of a manual feed sheet. A manual feed sheet type is selected by the user selecting a desired type from a sheet type list 911.

Figure 12E:
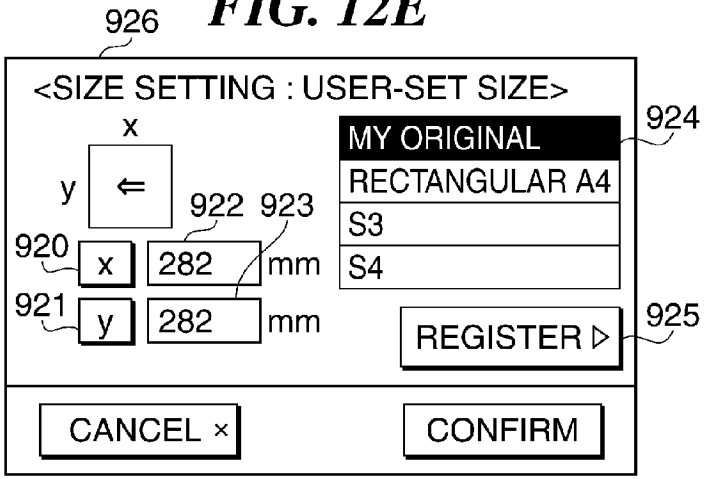

FIG. 12E is a view showing the user-set size setting screen 926. The user-set size setting screen 926 appearing in FIG. 12E is a screen for inputting a main scanning width (y) and a sub scanning width (x) of a sheet set as a manual feed sheet by a millimeter.

By depressing a button x 920, the user can enter a numeric value using the numeric keypad 405, and the input numeric value is displayed in a sub scanning width display area 922. By depressing a button y 921, the user can enter a numeric value using the numeric keypad 405, and the input numeric value is displayed in a main scanning width display area 923.

Information registered in the user-set size table 802 is displayed in a user-set size list 924, and from the information, the user can select a display name indicated in the user-set size list 924.

When there is no corresponding display name (Name) in the user-set size table 802 (NULL), part of a size code is displayed. For example, "S1" is displayed for USR_S1, "S2 is displayed for USR_S2, and "SN" is displayed for USR_SN.

When a size is selected from the user-set size list 924, a sub scanning width and a main scanning width which are registered are displayed in the sub scanning width display area 922 and the main scanning width display area 923, respectively.

Figure 12F:
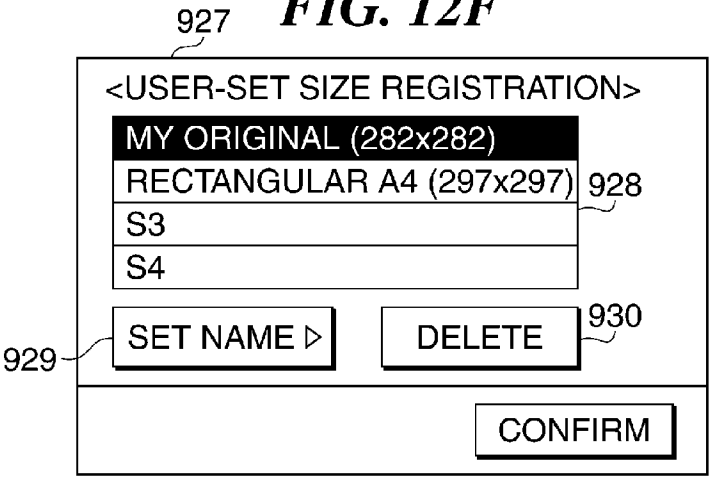

When the user depresses a user-set size registration button 925, the settings displayed in the sub scanning width display area 922 and the main scanning width display area 923 are held, and a user-set size registration screen 927 appearing in FIG. 12F is displayed.

FIG. 12F is a view showing the user-set size registration screen 927. Referring to FIG. 12F, the user selects, from a user-set size list 928, a display name desired to be associated with the main scanning width and the sub scanning width displayed in the sub scanning width display area 922 and the main scanning width display area 923, and depresses the confirm button. As a result, the user can register the selected size in the user-set size table 802. Display names displayed here in the user-set size list 928 are temporary display names, which are determined according to input sizes as shown in FIG. 12F.

When the user depresses a name setting button 929, a keyboard screen, not shown, is displayed, enabling the user to set a display name of the user-set size selected from the user-set size list 928. As a result, the user can reuse used settings for next printing as the need arises even when a sheet is an unregistered irregular-size sheet.

When a delete button 930 is depressed, the CPU 201 nulls the main scanning width (W), the sub scanning width (L), and the display name corresponding to the user-set size selected from the user-set size list 928 among user-set sizes stored in the user-set size table 802. As a result, information on the selected user-set size is deleted.

Figure 12G:
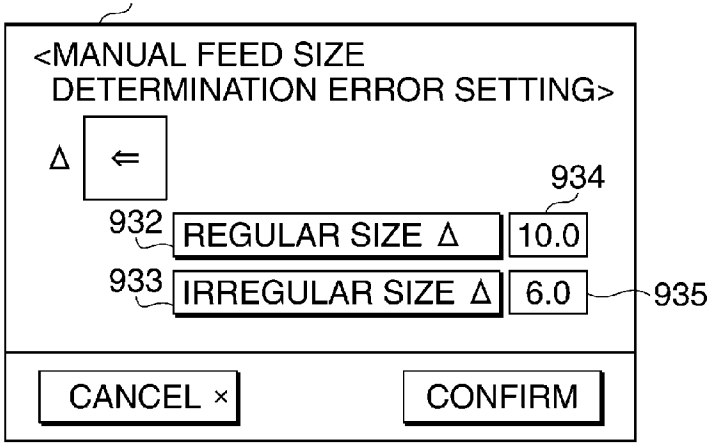

FIG. 12G is a view showing a manual feed size determination error setting screen 931. This manual feed size determination error setting screen 931 is displayed when an application mode button on a copy screen is depressed, and a button for setting a manual feed tray determination error is depressed. On the manual feed size determination error setting screen 931 appearing in FIG. 12G, the user can set a regular-size determination error (ΔS) and a user-set size determination error (ΔU).

By depressing a regular size Δ button 932, the user can enter an error (ΔS) in regular size determination by a tenths of a millimeter using the numeric keypad 405. The input error (ΔS) is displayed on a regular size determination error (ΔS) display area 934.

By depressing an irregular size Δ button 933, the user can enter an error (ΔU) in user-set size determination by a tenths of a millimeter using the numeric keypad 405. The input error (ΔU) is displayed on an irregular-size determination error (ΔU) display area 935.

The reason why errors can be set as described above is as follows: first, in the case of regular sizes, there may be a wide range of variation from manufacturer to manufacturer and from lot to lot, whereas in the case of special sizes which are frequently used by users, there is generally only a narrow range of variation because manufacturers and lots are fixed.

Therefore, if errors for regular-size determinations and irregular-size determinations are determined based on the same standard, even sizes of sheets that can be accurately detected by the guide could not be accurately determined.

Therefore, in the present embodiment, a set guide width is detected, and when the width of a registered sheet lies inside a range of the detected with plus an error tolerance (±X mm), the sheet is recognized as a candidate for a sheet for use in printing. An error tolerance for irregular-size sheets is set smaller than an error tolerance for regular-size sheets. Namely, determination accuracy is higher for irregular-size sheets than for regular-size sheets.

Figure 13:
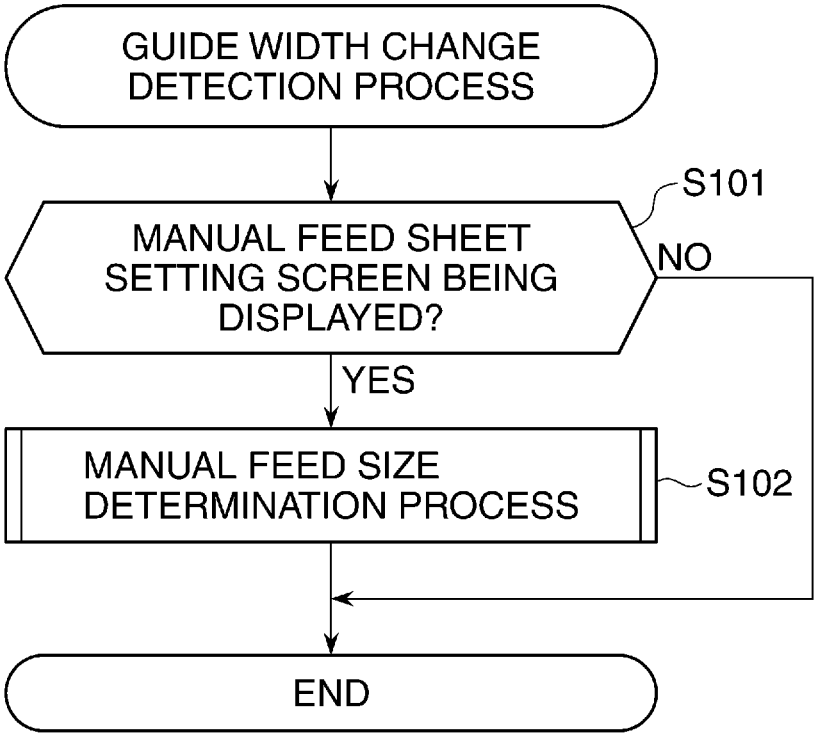
FIG. 13 is a flowchart showing the procedure of a guide width change detection process carried out by a CPU appearing in FIG. 2.

FIG. 13 is a flowchart showing the procedure of a guide width change detection process carried out by the CPU 201 appearing in FIG. 2. Processes in steps of this flowchart are carried out by the CPU 201 reading out a program stored in the ROM 210 and executing the same.

Referring to FIG. 13, when the user operates the guide 151A or the guide 151B, an analog voltage detected by the width detection volume 153 changes, and accordingly, a value to be converted by the manual feed D/A converter also changes.

Upon detecting the change in the value, the CPU 201 determines first whether or not the manual feed sheet setting screen 907 is being displayed (step S101). When, as a result of the determination in the step S101, the manual feed sheet setting screen 907 is not being displayed (NO in the step S101), the CPU 201 terminates the present process. It should be noted that based on a signal from the sensor 154 of the manual feed tray 304, the CPU 201 may determine whether or not a sheet is placed on the manual feed tray 304, and upon determining that a sheet is placed on the manual feed tray 304, the CPU 201 may carry out a process in step S102. Upon determining that no sheet is placed on the manual feed tray 304, the CPU 201 waits for a signal from the sensor 154 until a sheet is placed on the manual feed tray 304.

On the other hand, when the manual feed sheet setting screen 907 is being displayed (YES in the step S101), the CPU 201 carries out a manual feed size determination process in which it determines a size of the manual feed sheet (step S102) and terminates the present process.

Figure 14:
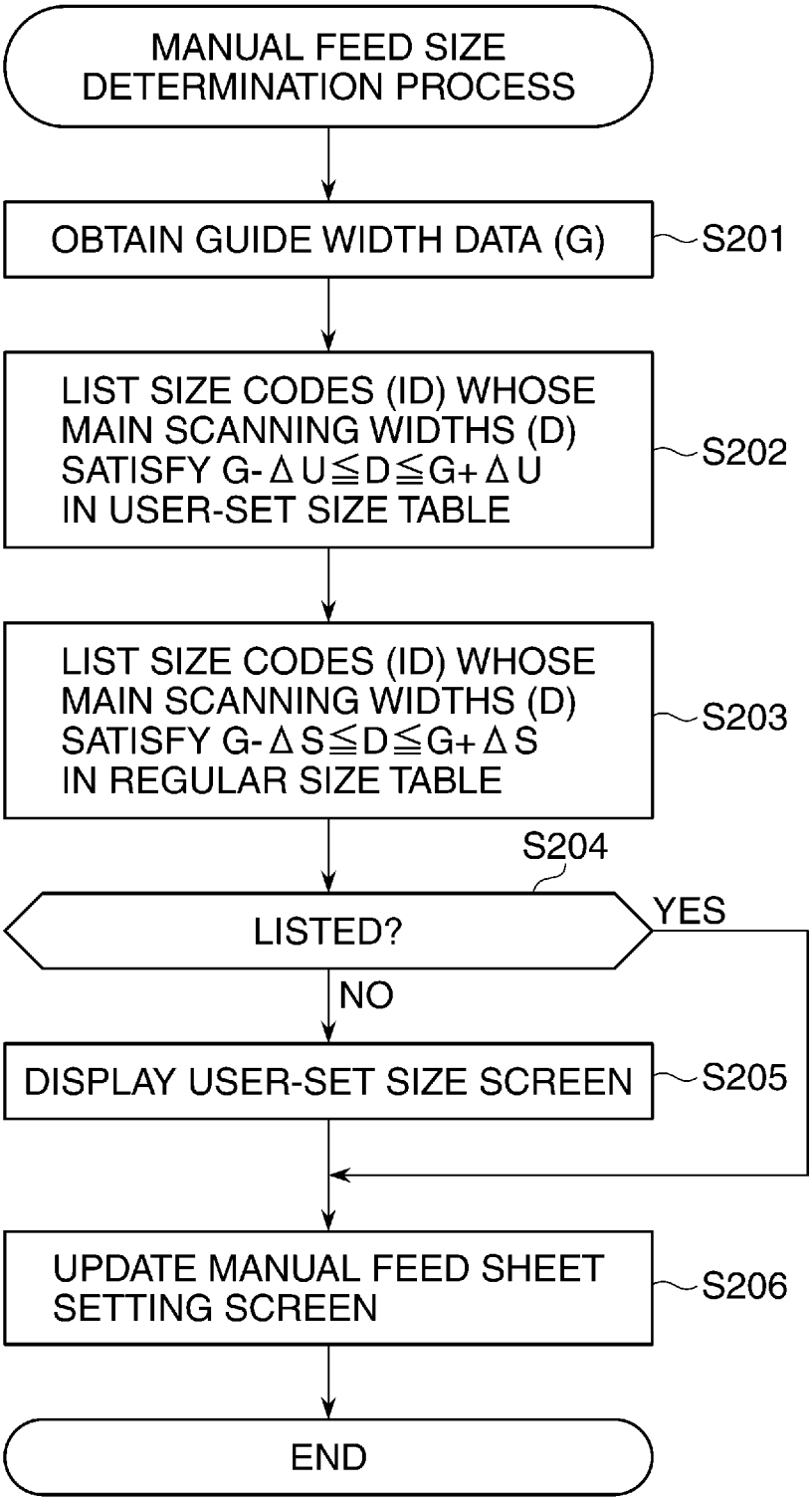
FIG. 14 is a flowchart showing the procedure of a manual feed size determination process in FIG. 13.

FIG. 14 is a flowchart showing the procedure of a manual feed size determination process in FIG. 13. Processes in steps of this flowchart are carried out by the CPU 201 reading out a program stored in the ROM 210 and executing the same.

Referring to FIG. 14, first, the CPU 201 obtains guide width data (G) by detecting an analog voltage using the width detection volume 153 (step S201). This step S201 corresponds to a detection unit that detects a width of a recording medium on which an image is to be formed.

Then, the CPU 201 lists (extracts) size codes (ID) whose main scanning widths (D) satisfy $G-\Delta U \leq D \leq G+\Delta U$ in the user-set size table 802 (step S202).

For example, in the example shown in FIG. 11, the CPU 201 uses G=287.0 and ΔU=6.0 and lists size codes (ID) whose main scanning widths (D) satisfy $281.0 \leq D \leq 293.0$. Specifically, referring to main scanning widths (D) in the user-set size table 802, ID=USR_S1 is listed because D=282.0 and it lies inside the range, but ID=USR_S2 is not listed because D=297.0 and it lies outside the range.

Here, the absolute value of a difference from a detected sheet width is $|D-G|$, and a user-set size determination error (first value) determined in advance is ΔU. Thus, candidates that satisfy $|D-G| \leq \Delta U$ are extracted. The step S202 corresponds to a first extraction unit that extracts from sheet widths set by the user, as candidates for a sheet on which an image is to be formed, sheets which correspond to sheet widths set by the user and whose absolute values of differences from a detected sheet width are equal to or smaller than the first value determined in advance.

Then, the CPU 201 further lists size codes (ID) whose main scanning widths (D) satisfy $G-\Delta S \leq D \leq G+\Delta S$ in the regular size table 801 (step S203).

For example, in the example shown in FIG. 11, the CPU 201 uses G=287.0 and ΔS=10.0 and lists size codes (ID) whose main scanning widths (D) satisfy $277.0 \leq D \leq 297.0$. Referring to main scanning widths (D) in the regular size table 801, both ID=A3 and ID=A4 are listed because D=297.0 which lies inside the range, and ID=LTR is listed because D=279.4 which lies inside the range, but ID=B4 and IDs that follow are not listed because D=275.0 or less which lies outside the range.

Here, the absolute value of a difference from a detected sheet width is $|D-G|$, and a regular size determination error (second value) determined in advance is ΔS. Thus, candidates that satisfy $|D-G| \leq \Delta S$ are extracted. Therefore, the step S203 corresponds to a second extraction unit that extracts from regular-size sheet widths, as candidates for a sheet on which an image is to be formed, sheets which correspond to regular-size sheet widths and whose absolute values of differences from a detected sheet width are equal to or smaller than the second value determined in advance.

The step S202 and the step S203 correspond to an extraction unit that uses a detected sheet width to extract candidates for a sheet on which an image is to be formed from widths represented by width information stored in the DISK 211.

Then, the CPU 201 determines whether or not the size codes (ID) have been listed (step S204). When, as a result of the determination in the step S204, no size code (ID) has been listed (NO in the step S204), the size of the sheet placed on the manual feed tray 304 is neither a user-set size nor a regular size. For this reason, the CPU 201 displays the user-set size setting screen 926 (step S205). As a result, the size of the sheet placed on the manual feed tray 304 can be input.

Then, the CPU 201 updates the manual feed sheet setting screen 907 with a value set by the user via the user-set size setting screen 926 (step S206) and terminates the present process. As a result, on the manual feed sheet setting screen 907, the size of the sheet placed on the manual feed tray 304 can be displayed in the candidate size list 908. On the other hand, when, as a result of the determination in the step S204, the size codes (ID) have been listed (YES in the step S204), the CPU 201 proceeds to the step S206. In the step S206, the CPU 201 displays, in the candidate size list 908, display names (or part of size codes) of user-set sizes corresponding to the listed size codes (ID) in the manual feed sheet setting screen 907.

This manual feed size determination process enables the user to easily select an irregular-size sheet from the candidate size list 908 and perform printing. The step S205 corresponds to a display unit that displays extracted sheet candidates on the display 203 so as to make the user select a sheet on which an image is to be formed. The first value ΔU and the second value ΔS can be set by the user as described above with reference to FIG. 12G. Also, as described above with reference to FIG. 12G, the first value ΔU may be set at a smaller value than the second value ΔS.

By the process described above, the image processing apparatus 100 forms an image on a sheet that is selected by the user from among sheet candidates displayed on the display 203. Although in the present embodiment, a width in the main scanning direction and a width in the sub scanning direction are used as sheet widths, widths in directions different from them may be used.

According to the processes in FIGS. 13 and 14, a width of a sheet on which an image is to be formed is detected (step S201), and using the detected sheet width, candidates for a recording medium on which an image is to be formed are extracted from widths represented by width information stored in the DISK 211 (steps S202 and 203). Then, the extracted sheet candidates are displayed on the display 203 so as to make the user select a sheet on which an image is to be formed (steps S205 and S206). Therefore, as compared to the prior art, time and effort for the user in forming an image on an irregular-size sheet can be reduced.

In the examples shown in FIGS. 13 and 14, sheet sizes determined by guide width data (G) are presented to the user like the manual feed sheet setting screen 907. A description will now be given of a variation in which as distinct from the embodiment described above, user-set sizes are prioritized and presented to the user.

In this variation as well, a guide width change detection process is carried out as described above with reference to FIG. 13, but whether or not the manual feed sheet setting screen 901 is being displayed is determined in this variation in place of whether or not the manual feed sheet setting screen 907. Then, a manual feed size determination process described hereafter is carried out.

Figure 15:
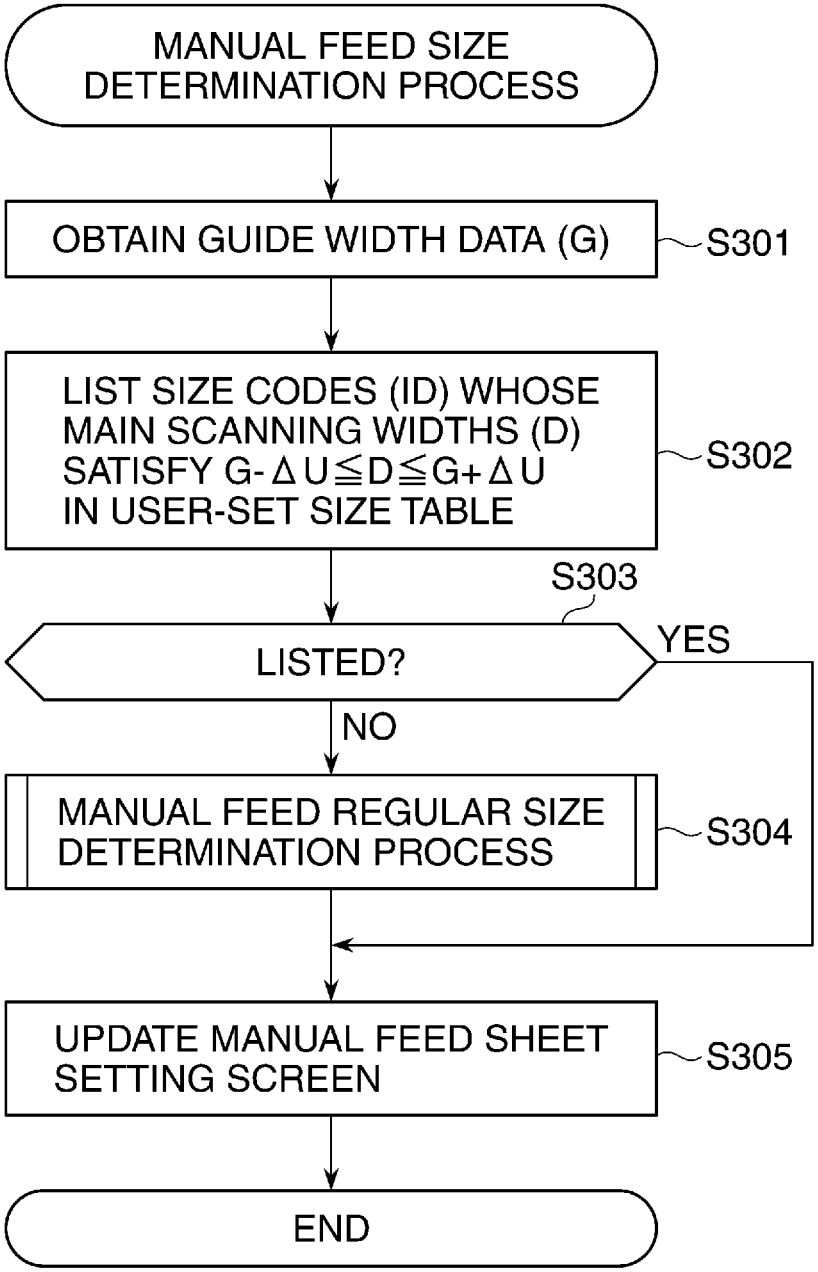
FIG. 15 is a flowchart showing the procedure of a manual feed size determination process according to a variation.

FIG. 15 is a flowchart showing the procedure of a manual feed size determination process according to the variation. Processes in steps of this flowchart are carried out by the CPU 201 reading out a program stored in the ROM 210 and executing the same. It should be noted that based on a signal from the sensor 154 of the manual feed tray 304, the CPU 201 may determine whether or not a sheet is placed on the manual feed tray 304, and upon determining that a sheet is placed on the manual feed tray 304, the CPU 201 may carry out the process in FIG. 15. Upon determining that no sheet is placed on the manual feed tray 304, the CPU 201 waits for a signal from the sensor 154 until a sheet is placed on the manual feed tray 304.

Referring to FIG. 15, first, the CPU 201 obtains guide width data (G) by detecting an analog voltage using the width detection volume 153 (step S301). Then, the CPU 201 lists size codes (ID) whose main scanning widths (D) satisfy $G-\Delta U \leq D \leq G+\Delta U$ in the user-set size table 802 (step S302).

For example, in the example shown in FIG. 11, the CPU 201 uses G=287.0 and ΔU=6.0 and lists size codes (ID) whose main scanning widths (D) satisfy $281.0 \leq D \leq 293.0$. Specifically, referring to main scanning widths (D) in the user-set size table 802, ID=USR_S1 is listed because D=282.0 and it lies inside the range, but ID=USR_S2 is not listed because D=297.0 and it lies outside the range.

Then, the CPU 201 determines whether or not the size codes (ID) have been listed (step S303). When, as a result of the determination in the step S303, no size code (ID) has been listed (NO in the step S303), this means that the sheet placed on the manual feed tray 304 is not stored in the user-set size table. For this reason, the CPU 201 carries out a manual feed regular-size determination process in which it lists size codes (ID) from the regular-size table 801 (step S304).

Then, the CPU 201 updates the manual feed sheet setting screen 901 being displayed (step S305) and terminates the present process. As a result, the latest display of the manual feed sheet setting screen 901 can be obtained. On the other hand, when, as a result of the determination in the step S303, the size codes (ID) have been listed (YES in the step S303), the CPU 201 proceeds to the step S305.

Figure 16:
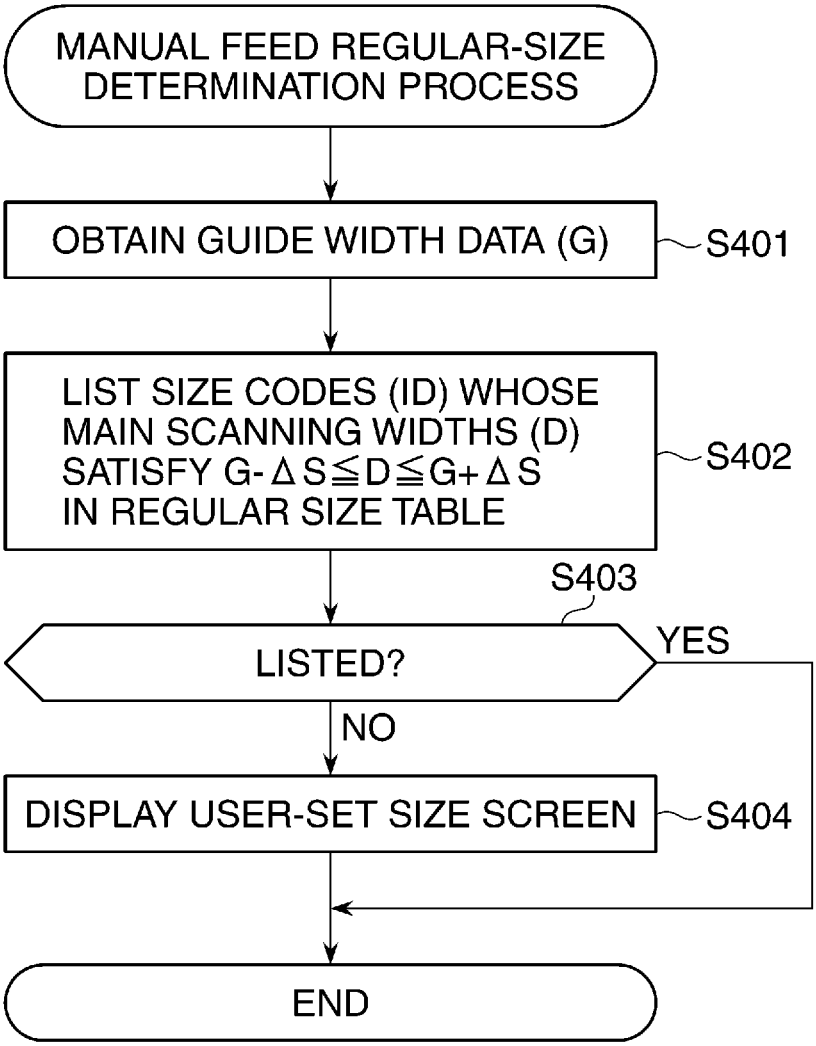
FIG. 16 is a flowchart showing the procedure of a manual feed regular-size determination process in FIG. 15.

FIG. 16 is a flowchart showing the procedure of the manual feed regular-size determination process in FIG. 15. Processes in steps of this flowchart are carried out by the CPU 201 reading out a program stored in the ROM 210 and executing the same.

Referring to FIG. 16, first, the CPU 201 obtains guide width data (G) by detecting an analog voltage using the width detection volume 153 (step S401). Then, the CPU 201 lists size codes (ID) whose main scanning widths (D) satisfy $G-\Delta S \leq D \leq G+\Delta S$ in the regular size table 801 (step S402).

For example, in the example shown in FIG. 11, the CPU 201 uses G=287.0 and ΔS=10.0 and lists size codes (ID) whose main scanning widths (D) satisfy $277.0 \leq D \leq 297.0$. Referring to main scanning widths (D) in the regular size table 801, both ID=A3 and ID=A4 are listed because D=297.0 which lies inside the range, and ID=LTR is listed because D=279.4 which lies inside the range, but ID=B4 and IDs that follow are not listed because D=275.0 or less which lies outside the range.

Then, the CPU 201 determines whether or not the size codes (ID) have been listed (step S403). When, as a result of the determination in the step S403, the size codes (ID) have been listed (YES in the step S403), the CPU 201 terminates the present process.

On the other hand, when, as a result of the determination in the step S 403, no size code (ID) has been listed (NO in the step S403), the size of the sheet placed on the manual feed tray 304 is neither a user-set size nor a regular size. For this reason, the CPU 201 displays the user-set size setting screen 926 (step S404) and terminates the present process. As a result, the size of the sheet placed on the manual feed tray 304 can be input.

According to the present embodiment, because a size of a sheet placed on the manual feed tray 304 is appropriately displayed as the need arises according to a guide width detected using the guide or a guide width detected by the trailing end sensor, irregular-size printing can be easily performed as with regular-size printing. It should be noted that the present invention may be applied to cases where various types of jobs involving printing are executed. The present invention may be applied to a case where a copy job is executed in which an image read off an original by the scanner 102 is printed by the printer 103. The present invention may also be applied to a case where a print job is executed in which PDL data received from the personal computer 107 or any other external apparatus such as an image processing apparatus is expanded, and an image is printed on a sheet based on the generated image data. The present invention may also be applied to a BOX print job in which image data stored in the DISK 211 is read in accordance with an instruction from the operation unit 106, and an image is printed on a sheet based on the read image data. Moreover, although in the present embodiment described above, a size of a sheet placed on the manual feed tray 304 is set, the same processes may be applied to other sheet holding units such as sheet feed cassettes and sheet feed decks by equipping them with similar guides.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-036329 filed Feb. 22, 2012, which is hereby incorporated by reference herein in its entirety.

What is claimed is:

1. An image forming apparatus comprising:
a sheet holding unit configured to hold a sheet;
an obtaining unit configured to obtain a width of the sheet held on said sheet holding unit;
a receiving unit configured to receive, from a user, size information indicating a size of a sheet;
a storage unit configured to store at least the size information received by said receiving unit; and
a selecting unit configured to select a size of the sheet held by said sheet holding unit based on the width obtained by the obtaining unit and the size information stored in said storage unit,
wherein said sheet holding unit is a manual feeding tray.

2. The image forming apparatus according to claim 1, further comprising a first display unit configured to display a screen on which a user is able to input the size information,
wherein said receiving unit is configured to receive the size information input by a user on the screen.

3. The image forming apparatus according to claim 1, wherein the size information received from a user indicates a size of a sheet different from a regular size.

4. An image forming apparatus comprising:
a sheet holding unit configured to hold a sheet;
an obtaining unit configured to obtain a width of the sheet held on said sheet holding unit;
a receiving unit configured to receive, from a user, size information indicating a size of a sheet;
a storage unit configured to store at least the size information received by said receiving unit;
a selecting unit configured to select a size of the sheet held by said sheet holding unit based on the width obtained by the obtaining unit and the size information stored in said storage unit; and
a display unit,
wherein said selecting unit is configured to select a plurality of sizes as candidates of a size of the sheet held by said sheet holding unit, and
said display unit is configured to display the plurality of sizes selected by said selecting unit.

5. An image forming apparatus comprising:
a sheet holding unit configured to hold a sheet;
an obtaining unit configured to obtain a width of the sheet held on said sheet holding unit;
a receiving unit configured to receive, from a user, size information indicating a size of a sheet;
a storage unit configured to store at least the size information received by said receiving unit; and
a selecting unit configured to select a size of the sheet held by said sheet holding unit based on the width obtained by the obtaining unit and the size information stored in said storage unit,
wherein said selecting unit is configured to select a size of the sheet held by said sheet holding unit further in consideration of a predetermined error.

6. An image forming apparatus comprising:
a sheet holding unit configured to hold a sheet;
an obtaining unit configured to obtain a width of the sheet held on said sheet holding unit;
a receiving unit configured to receive, from a user, size information indicating a size of a sheet;
a storage unit configured to store at least the size information received by said receiving unit; and
a selecting unit configured to select a size of the sheet held by said sheet holding unit based on the width obtained by the obtaining unit and the size information stored in said storage unit,
wherein said obtaining unit is configured to obtain a width of the sheet held on said sheet holding unit based on a position of at least one guide provided with the said sheet holding unit.

7. A control method for an image forming apparatus having a sheet holding unit configured to hold a sheet, comprising:
obtaining a width of the sheet held on said sheet holding unit;
receiving, from a user, size information indicating a size of a sheet;
storing at least the received size information; and
selecting a size of the sheet held by said sheet holding unit based on the obtained width and the stored size information,
wherein said sheet holding unit is a manual feeding tray.

8. A non-transitory computer readable storage medium storing a program for causing a computer to implement a control method for an image forming apparatus having a sheet holding unit configured to hold a sheet, the control method comprising:

obtaining a width of the sheet held on said sheet holding unit;

receiving, from a user, size information indicating a size of a sheet;

storing at least the received size information; and selecting a size of the sheet held by said sheet holding unit based on the obtained width and the stored size information, wherein said sheet holding unit is a manual feeding tray.

9. A control method for an image forming apparatus having a sheet holding unit configured to hold a sheet, comprising:

obtaining a width of the sheet held on said sheet holding unit;

receiving, from a user, size information indicating a size of a sheet;

storing at least the received size information;

selecting a plurality of sizes as candidates of a size of the sheet held by said sheet holding unit based on the obtained width and the stored size information; and displaying the plurality of sizes selected as candidates.

10. A non-transitory computer readable storage medium storing a program for causing a computer to implement a control method for an image forming apparatus having a sheet holding unit configured to hold a sheet, the control method comprising:

obtaining a width of the sheet held on said sheet holding unit;

receiving, from a user, size information indicating a size of a sheet;

storing at least the received size information;

selecting a plurality of sizes as candidates of a size of the sheet held by said sheet holding unit based on the obtained width and the stored size information; and displaying the plurality of sizes selected as candidates.

11. A control method for an image forming apparatus having a sheet holding unit configured to hold a sheet, comprising:

obtaining a width of the sheet held on said sheet holding unit;

receiving, from a user, size information indicating a size of a sheet;

storing at least the received size information; and selecting a size of the sheet held by said sheet holding unit based on the obtained width, the stored size information, and a predetermined error.

12. A non-transitory computer readable storage medium storing a program for causing a computer to implement a control method for an image forming apparatus having a sheet holding unit configured to hold a sheet, the control method comprising:

obtaining a width of the sheet held on said sheet holding unit;

receiving, from a user, size information indicating a size of a sheet;

storing at least the received size information; and selecting a size of the sheet held by said sheet holding unit based on the obtained width, the stored size information, and a predetermined error.

13. A control method for an image forming apparatus having a sheet holding unit configured to hold a sheet, comprising:

obtaining a width of the sheet held on said sheet holding unit based on a position of at least one guide provided with the said sheet holding unit;

receiving, from a user, size information indicating a size of a sheet;

storing at least the received size information; and selecting a size of the sheet held by said sheet holding unit based on the obtained width and the stored size information.

14. A non-transitory computer readable storage medium storing program for causing a computer to implement a control method for an image forming apparatus having a sheet holding unit configured to hold a sheet, the control method comprising:

obtaining a width of the sheet held on said sheet holding unit based on a position of at least one guide provided with the said sheet holding unit;

receiving, from a user, size information indicating a size of a sheet;

storing at least the received size information; and selecting a size of the sheet held by said sheet holding unit based on the obtained width and the stored size information.

* * * * *